US010242766B2

(12) United States Patent
Oshima et al.

(10) Patent No.: US 10,242,766 B2
(45) Date of Patent: Mar. 26, 2019

(54) HIGHLY BENDABLE INSULATED ELECTRIC WIRE AND WIRE HARNESS

(71) Applicant: Yazaki Corporation, Tokyo (JP)

(72) Inventors: Takeshi Oshima, Susono (JP); Yuki Tosaya, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/484,565

(22) Filed: Apr. 11, 2017

(65) Prior Publication Data

US 2017/0309369 A1 Oct. 26, 2017

(30) Foreign Application Priority Data

Apr. 25, 2016 (JP) ..... 2016-086746

(51) Int. Cl.
*H01B 7/00* (2006.01)
*H01B 1/02* (2006.01)
*H01B 7/29* (2006.01)

(52) U.S. Cl.
CPC ..... *H01B 7/0009* (2013.01); *H01B 1/026* (2013.01); *H01B 7/0045* (2013.01); *H01B 7/292* (2013.01)

(58) Field of Classification Search
CPC .... H01B 7/0009; H01B 1/026; H01B 7/0045; H01B 7/292; H01B 3/44; H01B 71/295; H01B 7/29
USPC ..... 174/113 R
See application file for complete search history.

(56) References Cited

U.S. PATENT DOCUMENTS

2004/0238086 A1* 12/2004 Saleh ..... C22C 9/00 148/684
2005/0106348 A1* 5/2005 Koike ..... C08L 23/10 428/36.9
2011/0005805 A1 1/2011 Eshima
2012/0018192 A1 1/2012 Takahashi et al.
2012/0217060 A1* 8/2012 Kusakari ..... C22C 21/02 174/72 A (Continued)

FOREIGN PATENT DOCUMENTS

CN 102356435 A 2/2012
CN 103275428 A 9/2013

(Continued)

OTHER PUBLICATIONS

PVC offers low-temperature properties for vehicle charging cables by: Plastics Today Staff in Materials, Compounding, Business, Extrusion: Pipe & Profile on May 29, 2014.*

(Continued)

*Primary Examiner* — Timothy Thompson
*Assistant Examiner* — Michael F McAllister
(74) *Attorney, Agent, or Firm* — Sughrue Mion, PLLC

(57) ABSTRACT

A highly bendable insulated electric wire includes a conductor part that has a plurality of non-compressed strands made of a copper alloy, each of the non-compressed strands having a cross-sectional area of 0.13 sq. mm, and a covering part that is provided on the conductor part, wherein the conductor part has an elongation of 7% or more and a tensile strength of 500 MPa or more, and the covering part is made of 100 degree Celsius heat-resistant polyvinyl chloride and has an elongation of 100% or more at a temperature of −40 degree Celsius.

4 Claims, 3 Drawing Sheets

| ITEMS | | EXAMPLE | COMPARATIVE EXAMPLE 1 | COMPARATIVE EXAMPLE 2 | COMPARATIVE EXAMPLE 3 |
|---|---|---|---|---|---|
| CON-DUCTOR | SIZE | 0.13sq.mm | 0.35sq.mm | 0.13sq.mm | 0.13sq.mm |
| | SPECIFICATIONS | NON-COMPRESSED | NON-COMPRESSED | COMPRESSED | COMPRESSED |
| | MATERIAL | COPPER ALLOY | PURE COPPER | COPPER ALLOY | COPPER ALLOY |
| | TENSILE STRENGTH (MPa) | 530 | 250 | 530 | 530 |
| | ELONGATION (%) | 10 | 23 | 10 | 10 |
| COVER-ING | MATERIAL | PVC | PVC | PVC | PVC |
| | HEAT RESISTANCE | 100°C HEAT RESISTANT | 100°C HEAT RESISTANT | 80°C HEAT RESISTANT | 80°C HEAT RESISTANT |
| | TENSILE STRENGTH (MPa) | 45 | 45 | 45 | 45 |
| | ELONGATION (%) | 270 | 270 | 300 | 300 |
| NUMBER OF TIMES OF BENDING AT ROOM TEMPERATURE | | GOOD | POOR | NORMAL | GOOD |
| NUMBER OF TIMES OF BENDING AT LOW TEMPERATURE | | GOOD | NORMAL | POOR | POOR |

(56) References Cited

U.S. PATENT DOCUMENTS

| | | | | |
|---|---|---|---|---|
| 2015/0093529 | A1* | 4/2015 | Fujita | H01B 3/441<br>428/36.9 |
| 2015/0213922 | A1* | 7/2015 | Matsuno | H01B 7/0009<br>174/119 R |
| 2015/0294758 | A1* | 10/2015 | Kumada | C22C 9/06<br>174/110 R |

FOREIGN PATENT DOCUMENTS

| | | | |
|---|---|---|---|
| CN | 104885164 | A | 9/2015 |
| JP | 2005-197135 | A | 7/2005 |
| JP | 2011-18545 | A | 1/2011 |
| JP | 2011-126980 | A | 6/2011 |
| JP | 2015-143299 | A | 8/2015 |
| JP | 2015-203136 | * | 11/2015 |

OTHER PUBLICATIONS

Leoni Automotive Cables Nov. 17, 2014 www.leoni-automotive-cables.com.*

Communication issued by the Japanese Patent Office dated on Jan. 9, 2018 in counterpart Japanese Patent Application No. 2016-086746.

Communication dated Jul. 30, 2018, issued by the State Intellectual Property Office of the People's Republic of China in counterpart Chinese Patent Application No. 201710278591.2.

Communication dated Dec. 18, 2018, issued by the State Intellectual Property Office of P.R. China in counterpart Chinese Application No. 201710278591.2.

* cited by examiner

FIG. 3

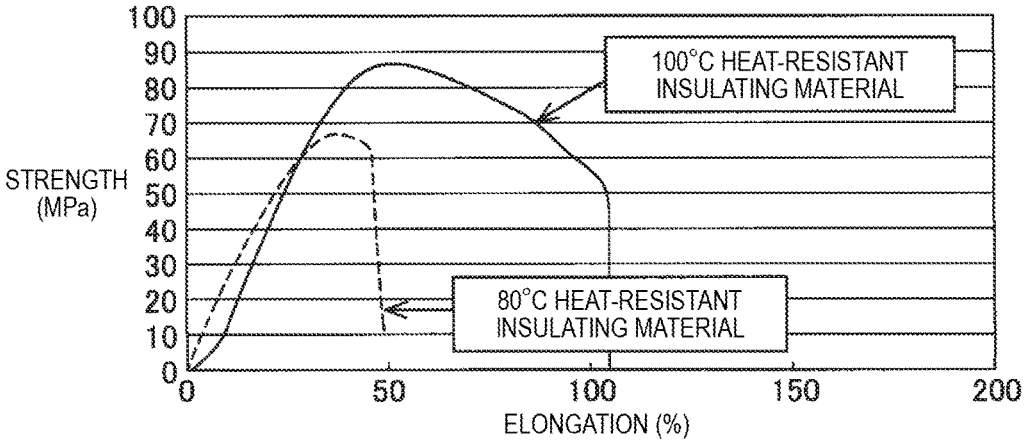

FIG. 4

| ITEMS | | EXAMPLE | COMPARATIVE EXAMPLE 1 | COMPARATIVE EXAMPLE 2 | COMPARATIVE EXAMPLE 3 |
|---|---|---|---|---|---|
| CON-DUCTOR | SIZE | 0.13sq.mm | 0.35sq.mm | 0.13sq.mm | 0.13sq.mm |
| | SPECIFICATIONS | NON-COMPRESSED | NON-COMPRESSED | COMPRESSED | COMPRESSED |
| | MATERIAL | COPPER ALLOY | PURE COPPER | COPPER ALLOY | COPPER ALLOY |
| | TENSILE STRENGTH (MPa) | 530 | 250 | 530 | 530 |
| | ELONGATION (%) | 10 | 23 | 10 | 10 |
| COVER-ING | MATERIAL | PVC | PVC | PVC | PVC |
| | HEAT RESISTANCE | 100°C HEAT RESISTANT | 100°C HEAT RESISTANT | 80°C HEAT RESISTANT | 80°C HEAT RESISTANT |
| | TENSILE STRENGTH (MPa) | 45 | 45 | 45 | 45 |
| | ELONGATION (%) | 270 | 270 | 300 | 300 |
| NUMBER OF TIMES OF BENDING AT ROOM TEMPERATURE | | GOOD | POOR | NORMAL | GOOD |
| NUMBER OF TIMES OF BENDING AT LOW TEMPERATURE | | GOOD | NORMAL | POOR | POOR |

HIGHLY BENDABLE INSULATED ELECTRIC WIRE AND WIRE HARNESS

CROSS REFERENCE TO RELATED APPLICATION

This application is based on Japanese Patent Application No. 2016-086746 filed on Apr. 25, 2016, the contents of which are incorporated herein by reference.

BACKGROUND

1. Technical Field

The present invention relates to a highly bendable insulated electric wire and a wire harness.

2. Background Art

In the background art, insulated electric wires each having a conductor cross-sectional area of 0.13 sq. mm have been proposed. When a conductor in such an insulated electric wire is thinned, the insulated electric wire can be made lighter in weight. In addition, there is a tendency that the insulated electric wire having the conductor cross-sectional area of 0.13 sq. mm is required to have higher bending resistance in a wide temperature range so as to be capable of withstanding automobile environments.

For example, a technique for improving bendability of the electric wire has been proposed (see JP-A-2005-197135). That is, a plurality of metal strands are twisted into a stranded wire. A plurality of such stranded wires are further twisted into a conductor part. According to the technique, double-twisting including twisting of the strands and twisting of the stranded wires is performed so that the diameter of each of the metal strands can be reduced and distortion of the strand during bending can be reduced. Thus, bending resistance can be improved.

In addition, another technique has been proposed (see JP-A-2011-126980). That is, a material excellent in cold resistance is used for an insulation covering of an electric wire to provide an electric wire having excellent bendability at low temperature.

Further, another electric wire has been also proposed (see JP-A-2011-18545). In the electric wire, an inclusion is interposed between adjacent ones of strands to reduce friction among the strands. Accordingly, bending resistance of the electric wire can be improved.

However, it is necessary to perform double-twisting in the electric wire according to JP-A-2005-197135. This therefore results in an increase in the number of production man-hours and an increase in the cost of the electric wire. In addition, in the electric wire according to JP-A-2011-126980 which is improved in bendability at low temperature, there is room for improvement in bendability at room temperature. Further, the inclusion is used in the electric wire according to JP-A-2011-18545. Accordingly, the number of production man-hours and the cost of the electric wire increase in accordance with the interposition of the inclusion.

The invention has been accomplished in order to solve such matters inherent in the background art. An object of the invention is to provide a highly bendable insulated electric wire and a wire harness in which an increase in the number of production man-hours and an increase in the cost of the electric wire can be suppressed and bendability at low temperature and bendability at room temperature can be improved simultaneously.

SUMMARY (1) According to an aspect of the invention, a highly bendable insulated electric wire includes a conductor part that has a plurality of non-compressed strands made of a copper alloy, each of the non-compressed strands having a cross-sectional area of 0.13 sq. mm, and a covering part that is provided on the conductor part, wherein the conductor part has an elongation of 7% or more and a tensile strength of 500 MPa or more, and the covering part is made of 100 degree Celsius heat-resistant polyvinyl chloride and has an elongation of 100% or more at a temperature of −40 degree Celsius.

According to the highly bendable insulated electric wire of (1), the conductor part has the elongation of 7% or more and the tensile strength of 500 MPa or more. Accordingly, the conductor part which is more excellent in both the elongation and the tensile strength can be used to form a conductor excellent in bending resistance. Further, the conductor part is constituted by the plurality of non-compressed strands. Accordingly, degradation of bendability caused by compressed strands can be suppressed. In addition, the covering part is made of the 100 degree Celsius heat-resistant polyvinyl chloride. Accordingly, the covering part is excellent in bendability at room temperature. Moreover, the covering part has the elongation of 100% or more at the temperature of −40 degree Celsius. Accordingly, the covering part is also excellent in bendability at low temperature. Further, it is also unnecessary to use double-twisting or an inclusion. Accordingly, an increase in the number of production man-hours and an increase in the cost of the electric wire can be suppressed. In addition, bendability at low temperature and bendability at room temperature can be improved simultaneously.

(2) In the highly bendable insulated electric wire of (1), it is preferable that the number of times of reciprocating motion of the highly bendable insulated electric wire until a resistance value of the conductor part increases by 10% reaches 10,000 or more when a weight of 400 g is attached to one end of the highly bendable insulated electric wire and the one end is used as a fixed side and the other end side of the highly bendable insulated electric wire is bent repeatedly at a temperature of 23 degree Celsius and at a speed of 30 rpm in an angular range of from −90 degree to 90 degree by use of mandrels each of which has a radium of 12.5 mm, and the number of times of reciprocating motion of the highly bendable insulated electric wire until the resistance value of the conductor part increases by 10% reaches 3,000 or more when the weight of 400 g is attached to the one end and the one end is used as the fixed side while the other end side is bent repeatedly at a temperature of −30 degree Celsius and at the speed of 30 rpm in the angular range of from −90 degree to 90 degree by use of the mandrels each of which has the radium of 12.5 mm.

According to the highly bendable insulated electric wire of (2), the number of times of reciprocating motion of the highly bendable insulated electric wire until the resistance value of the conductor part increases by 10% reaches 10,000 or more at the temperature of 23 degree Celsius, and the number of times of reciprocating motion of the highly bendable insulated electric wire until the resistance value of the conductor part increases by 10% reaches 3,000 or more at the temperature of −30 degree Celsius. Accordingly, it is possible to provide a highly bendable insulated electric wire which can be surely bent at least predetermined numbers of times respectively at low temperature and at room temperature.

(3) According to another aspect of the invention, a wire harness includes a highly bendable insulated electric wire of (1) or (2).

According to the wire harness of (3), it is possible to provide a wire harness including a highly bendable insulated electric wire in which an increase in the number of production man-hours and an increase in the cost of the electric wire can be suppressed and bendability at low temperature and bendability at room temperature can be improved simultaneously.

According to the invention, it is possible to provide a highly bendable insulated electric wire and a wire harness, in which an increase in the number of production man-hours and an increase in the cost of the electric wire can be suppressed and bendability at low temperature and bendability at room temperature can be improved simultaneously.

BRIEF DESCRIPTION OF DRAWINGS

FIG. 3 is a graph showing elongations of 100 degree Celsius heat-resistant polyvinyl chloride (polymerization degree of 2,000: material 1) and 80 degree Celsius heat-resistant polyvinyl chloride (polymerization degree of 1,300: material 2) at a temperature of −40 degree Celsius.

FIG. 4 is a table showing detailed configurations of a highly bendable insulated electric wire according to Example and electric wires according to Comparative Examples 1 to 3, and results of a bending resistance test performed on the electric wires.

DETAILED DESCRIPTION OF EMBODIMENT

Although a preferred embodiment of the invention will be described below based on the drawings, the invention is not limited to the following embodiment and can be changed suitably without departing from the gist of the invention.

Figure 1:
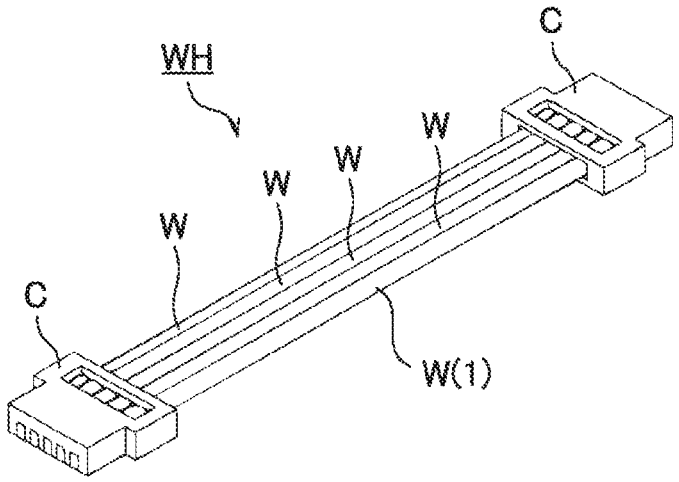
FIG. 1 is a view of a wire harness including a highly bendable insulated electric wire according to an embodiment of the invention.

FIG. 1 shows a view of a wire harness including a highly bendable insulated electric wire according to an embodiment of the invention. As shown in FIG. 1, a wire harness WH is provided as a bundle of electric wires W. At least one (one circuit) of the electric wires W is constituted by a highly bendable insulated electric wire 1 which will be described below in detail. Such a wire harness WH may be provided with connectors C at opposite end portions of the electric wires W, for example, as shown in FIG. 1, or tape (not shown) may be wrapped around such a wire harness WH in order to bind the electric wires W into one bundle. In addition, the wire harness WH may be provided with a jacket component (not shown) such as a corrugated tube.

Figure 2:
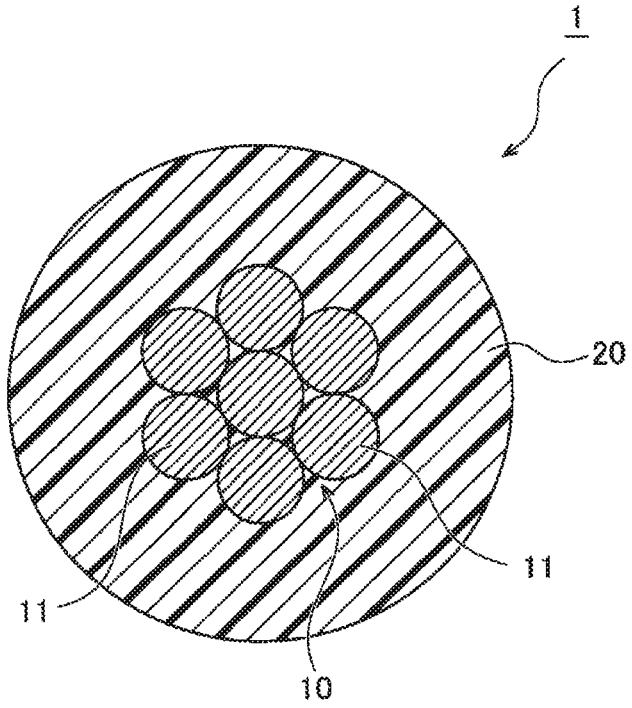
FIG. 2 is a sectional view of the highly bendable insulated electric wire shown in FIG. 1.

FIG. 2 is a sectional view of the highly bendable insulated electric wire shown in FIG. 1. As shown in FIG. 2, the highly bendable insulated electric wire 1 according to the embodiment is an insulated electric wire having a cross-sectional area of 0.13 sq. mm as described in the ISO6722 standard. The highly bendable insulated electric wire 1 is constituted by a conductor part 10 and a covering part 20. The conductor part 10 is constituted by a plurality of (seven) non-compressed strands 11 made of a precipitation strengthened type copper alloy. The covering part 20 is provided on the conductor part 10. The pluralities of non-compressed strands 11 are twisted to form the conductor part 10. Incidentally, the conductor part. 10 is only required to have the cross-sectional area of 0.13 sq. mm. For example, the conductor part 10 may be one described in the JASO D 611 standard. Further, the conductor part 10 is not limited to the precipitation strengthened type copper alloy.

Here, for example, the precipitation strengthened type copper alloy used for the conductor part 10 may be made of one selected from Cu—Cr-based, Cu—Cr—Zr-based, Cu—Cr—Zn-based, Cu—Co—P-based, Cu—Ni—P-based and Cu—Fe—P-based copper alloys etc.

In such a conductor part 10, blending ratios of respective metals are as follows. That is, when the conductor part. 10 is made of a Cu—Cr—Zr-based copper alloy, the blending ratio of Cr is 0.50 to 1.50 mass %, the blending ratio of Zr is 0.05 to 0.15 mass %, the blending ratio of Sn is 0.10 to 0.20 mass %, and the balance is Cu. In addition, the conductor part 10 is made of a Cu—Co—P-based copper alloy, the blending ratio of Co is 0.20 to 0.30 mass %, the blending ratio of P is 0.07 to 0.12 mass %, and the blending ratio of Ni is 0.02 to 0.05 mass %. Further, the blending ratio of Sn is 0.08 to 0.12 mass %, the blending ratio of Zn is 0.01 to 0.04 mass % and the balance is Cu.

In addition, the conductor part 10 in the embodiment has an elongation of 7% or more and a tensile strength of 500 MPa or more at room temperature (23 degree Celsius). Thus, the conductor part which is more excellent in both the elongation and the tensile strength can be used to form a conductor excellent in bending resistance.

In addition, it is desirable that the elongation is less than 20%. The elongation and the tensile strength are correlated. Therefore, when the elongation is changed, the tensile strength also changes. Due to this correlation, the conductor part made of a copper-based alloy cannot keep the tensile strength of 500 MPa when the elongation reaches 20% or more. Further, it is desirable that the tensile strength is lower than 750 MPa. The conductor part made of a copper-based alloy cannot keep the elongation of 7% when the tensile strength reaches 750 MPa or more.

The aforementioned precipitation strengthened type copper alloy is preferably used for producing the conductor part 10 having such an elongation and such a tensile strength. However, it is not necessary to use the precipitation strengthened type copper alloy particularly. Incidentally, it is impossible to use pure copper or soft copper to produce the conductor part 10 having the aforementioned elongation and the aforementioned tensile strength.

The covering part 20 is made of 100 degree Celsius heat-resistant polyvinyl chloride. The 100 degree Celsius heat-resistant polyvinyl chloride means polyvinyl chloride which has an elongation of 100% or more after being exposed at a temperature of 100 degree Celsius for 10,000 hours. Polyvinyl chloride higher in polymerization degree is more stable and also stronger against heat. That is, the 100 degree Celsius heat-resistant polyvinyl chloride means polyvinyl chloride having a polymerization degree not lower than a predetermined value.

Further, of the aforementioned 100 degree Celsius heat-resistant polyvinyl chloride, one having an elongation of 100% or more at a temperature of −40 degree Celsius is used as the material of the covering part 20. Thus, a covering excellent in bendability both at low temperature and at room temperature can be formed. Specifically, the 100 degree Celsius heat-resistant polyvinyl chloride having the elongation of 100% or more at the temperature of −40 degree Celsius has a polymerization degree of 2,000 or more.

FIG. 3 is a graph showing elongations of 100 degree Celsius heat-resistant polyvinyl chloride (polymerization degree of 2.000: material 1) and 80 degree Celsius heat-resistant polyvinyl chloride (polymerization degree of 1,300: material 2) at a temperature of −40 degree Celsius. Incidentally, the 80 degree Celsius heat-resistant polyvinyl chloride is polyvinyl chloride which has an elongation of 100% or more after being exposed at a temperature of 80 degree Celsius for 10,000 hours.

As shown in FIG. 3, the 100 degree Celsius heat-resistant polyvinyl chloride of the material 1 has the elongation which increases proportionally as the tensile strength increases. The elongation of the 100 degree Celsius heat-resistant polyvinyl chloride of the material 1 is about 50% at the tensile strength of 87 MPa. Incidentally, the tensile strength of 87 MPa and the elongation of about 50% corresponds to an upper yield point. After the upper yield point, the tensile strength tends to decrease unless the elongation reaches about 105%. The material 1 is broken when the tensile strength is a little more than 50 MPa and the elongation is about 105%.

On the other hand, the 80 degree Celsius heat-resistant polyvinyl chloride of the material 2 has the elongation which increases proportionally as the tensile strength increases. The elongation of the 80 degree Celsius heat-resistant polyvinyl chloride of the material 2 is a little less than 40% at the tensile strength of about 67 MPa. Incidentally, the tensile strength of about 67 MPa and the elongation a little less than 40% corresponds to an upper yield point. After the upper yield point, the tensile strength tends to decrease unless the elongation reaches a little less than 50%. The material 2 is broken when the tensile strength is a little more than 60 MPa and the elongation is a little less than 50%.

Thus, the 80 degree Celsius heat-resistant polyvinyl chloride of the material 2 has a lower elongation and less excellent bendability than the 100 degree Celsius heat-resistant polyvinyl chloride of the material 1 at low temperature. On the other hand, it has been proven that the 100 degree Celsius heat-resistant polyvinyl chloride of the material 1 has more excellent bendability at low temperature.

Next, Example and Comparative Examples will be described. FIG. 4 is a table showing detailed configurations of a highly bendable insulated electric wire according to Example and electric wires according to Comparative Examples 1 to 3, and results of a bending resistance test performed on the electric wires.

As shown in FIG. 4, a conductor part in the highly bendable insulated electric wire according to Example has a cross-sectional area of 0.13 sq. mm. In the conductor part, seven strands are twisted in a non-compression manner. The seven strands are made of a precipitation strengthened type copper alloy. Such a conductor part has a tensile strength of 530 MPa and an elongation of 10% at room temperature.

In addition, the 100 degree Celsius heat-resistant polyvinyl chloride (polymerization degree of 2,000) is used as the material of a covering part in Example. The covering part in Example has a tensile strength of 45 MPa and an elongation of 270% at room temperature (23 degree Celsius).

A conductor part in the electric wire according to Comparative Example 1 has a cross-sectional area of 0.35 sq. mm. In the conductor part, seven strands are twisted in a non-compressed manner. The seven strands are made of pure copper. Such a conductor part has a tensile strength of 250 MPa and an elongation of 23% at room temperature. In addition, 100 degree Celsius heat-resistant polyvinyl chloride (polymerization degree of 2,000) of the material 1 is used as the material of a covering part in Comparative Example 1. The covering part in Comparative Example 1 has a tensile strength of 45 MPa and an elongation of 270% at room temperature (23 degree Celsius).

A conductor part in the electric wire according to Comparative Example 2 has a cross-sectional area of 0.13 sq. mm. In the conductor part, seven strands are twisted in a compressed manner. The seven strands are made of a precipitation strengthened type copper alloy. Such a conductor part has a tensile strength of 530 MPa and an elongation of 10% at room temperature. In addition, 80 degree Celsius heat-resistant polyvinyl chloride (polymerization degree of 1,300) is used as the material of a covering part in Comparative Example 2. The covering part in Comparative Example 2 has a tensile strength of 45 MPa and an elongation of 300% at room temperature (23 degree Celsius).

A conductor part in the electric wire according to Comparative Example 3 has a cross-sectional area of 0.13 sq. mm. In the conductor part, seven strands are twisted in a non-compressed manner. The seven strands are made of a precipitation strengthened type copper alloy. Such a conductor part has a tensile strength of 530 MPa and an elongation of 10% at room temperature. In addition, 80 degree Celsius heat-resistant polyvinyl chloride (polymerization degree of 2,000) is used as the material of a covering part in Comparative Example 3. The covering part in Comparative Example 3 has a tensile strength of 45 MPa and an elongation of 300% at room temperature (23 degree Celsius).

Figure 5:
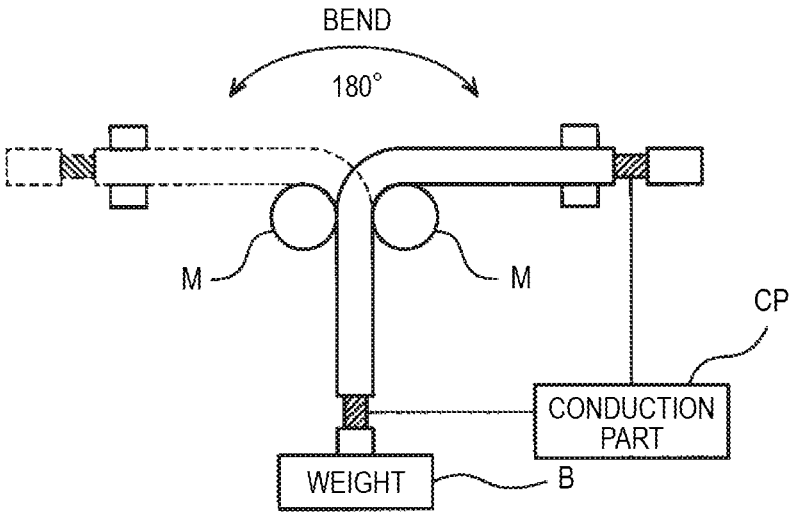
FIG. 5 is a schematic view showing a state of the bending resistance test.

FIG. 5 is a schematic view showing a state of the bending resistance test. The bending resistance test was performed by use of a cylindrical mandrel bending testing machine shown in FIG. 5. Specifically, in a state in which one end of each of the electric wires according to Example and Comparative Examples 1 to 3 was fixed and the electric wire was stretched straight, the other end side of the electric wire was bent repeatedly in an angular range of from −90° to 90° at room temperature (23 degree Celsius) or at low temperature (−30 degree Celsius) by use of mandrels M each having a radium of 12.5 mm. The number of times of the bending (the number of reciprocating motions) when some of strands of the electric wire were disconnected was measured. A conduction part CP was used to measure a resistance value of the conductor part. When the resistance value of the conductor part increased by a predetermined value (10%) or higher, it was determined that some of the strands were broken. Incidentally, the load of a weight B attached to the one end of the electric wire was set at 400 g both at the room temperature and at the low temperature. In addition, the bending speed was set at 30 rpm both at the room temperature and at the low temperature.

In FIG. 4, an electric wire which was bent 12,000 times or more at the room temperature was evaluated as "GOOD", an electric wire which was bent 10,000 times to 11,999 times at the room temperature was evaluated as "NORMAL", and an electric wire which was bent 9,999 times or less at the room temperature was evaluated as "POOR". In addition, an electric wire which was bent 5,000 times or more at the low temperature was evaluated as "GOOD", an electric wire which was bent 3,000 times to 4,999 times at the low temperature was evaluated as "NORMAL", and an electric wire which was bent 2,999 times or less at the low temperature was evaluated as "POOR".

As results of the aforementioned bending resistance test, in terms of the number of times of bending at the room temperature, Example was evaluated as "GOOD", and Comparative Example 1 was evaluated as "POOR", Comparative Example 2 was evaluated as "NORMAL", and Comparative Example 3 was evaluated as "GOOD". From the above description, it has been proven that the conductor made of the precipitation strengthened type copper alloy (copper alloy having an elongation of 7% or more and a tensile strength of 500 MPa or more at room temperature (23 degree Celsius)) was higher in bending resistance at the room temperature than the conductor made of the pure copper, and the conductor in the non-compressed state was higher in bending resistance at the room temperature than the conductor in the compressed state.

Further, in terms of the number of times of bending at the low temperature, Example was evaluated as "GOOD", Comparative Example 1 was evaluated as "NORMAL", Comparative Example 2 was evaluated as "POOR" and Comparative Example 3 a highly bendable insulated electric wire was evaluated as "POOR". From the above description, it has been proven that the covering part made of the 100 degree Celsius heat-resistant polyvinyl chloride was higher in bending resistance at the low temperature than the covering part made of the 80 degree Celsius heat-resistant polyvinyl chloride. Incidentally, the results of Example and Comparative Example 1 are different to be "○○" and "NORMAL" respectively. It is considered that the results are affected by a difference between the conductors in Example and Comparative Example 1.

In this manner, the conductor part 10 has an elongation of 7% or more and a tensile strength of 500 MPa or more according to the highly bendable insulated electric wire 1 and the wire harness WH according to the embodiment. Therefore, the conductor part 10 more excellent in the elongation and the tensile strength can be used to form a conductor excellent in bending resistance. Further, the conductor part. 10 is constituted by a plurality of non-compressed strands 11 so that degradation of bendability caused by compressed strands can be suppressed. In addition, the covering part 20 is made of 100 degree Celsius heat-resistant polyvinyl chloride. Accordingly, the covering part 20 is excellent in bendability at room temperature. Moreover, the covering part 20 has an elongation of 100% or more at a temperature of −40 degree Celsius. Accordingly, the covering part 20 is also excellent in bendability at low temperature. Further, it is not necessary to use double-twisting or an inclusion. Accordingly, an increase in the number of production man-hours and an increase in the cost of the electric wire can be suppressed, and bendability at the low temperature and bendability at the room temperature can be improved simultaneously.

In addition, the number of times of reciprocating motion at a temperature of 23° until the resistance value of the conductor part 10 increases by 10% reaches 10,000 times or more, and the number of times of reciprocating motion at a temperature of −30 degree Celsius until the resistance value of the conductor part 10 increases by 10% reaches 3,000 times or more. Accordingly, it is possible to provide a highly bendable insulated electric wire 1 which can be surely bent at least predetermined numbers of times respectively at low temperature and at room temperature.

Although the invention has been described based on the embodiment, the invention is not limited to the aforementioned embodiment but may be changed without departing from the gist of the invention. For example, the precipitation strengthened type copper alloy is not limited to the aforementioned one. In addition, the copper alloy used for the conductor part 10 is limited to the precipitation strengthened type.

In addition, in the aforementioned embodiment, it is desirable that electrical conductivity of the conductor part 10 is 70% IACS or more. In the aforementioned embodiment, it is possible to provide a highly bendable insulated electric wire 1 in which an increase in the number of production man-hours and an increase in the cost of the electric wire can be suppressed and bendability at low temperature and bendability at room temperature can be improved simultaneously. However, when the highly bendable insulated electric wire 1 is produced without taking the electrical conductivity of the conductor part 10 into consideration, the electrical conductivity may be lowered. In this case, the highly bendable insulated electric wire 1 can be only used for a signal line for transmitting a switch signal etc.

Here, it has been known that the tensile strength and the electrical conductivity are correlated. Therefore, when the conductor part 10 is produced only in consideration of the elongation and the tensile strength, there is a fear that only the conductor part 10 low in electrical conductivity can be provided. The highly bendable insulated electric wire 1 can be used only as a signal line. However, when the tensile strength is tempered not only to make the tensile strength 500 MPa or more but also to make the electric conductivity 70% IACS or more, the highly bendable insulated electric wire 1 can be produced not only as a signal line but also as a power supply line for applying a small current.

In addition, the polymerization degree of the 100 degree Celsius heat-resistant polyvinyl chloride in the aforementioned embodiment etc. is 2,000. However, the polymerization degree is not limited to 2,000. Polyvinyl chloride higher in polymerization degree is more stable and also stronger against heat. Accordingly, polyvinyl chloride higher in polymerization degree is preferred in view of bendability.

REFERENCE SIGNS LIST

1: highly bendable insulated electric wire
10: conductor par
11: non-compressed strand
20: covering part
B: weight
C: connector
CP: conduction part
M: mandrel
W: electric wire
WH: wire harness

What is claimed is:

1. A highly bendable insulated electric wire comprising:
a conductor part that has a plurality of non-compressed strands made of a copper alloy, each of the non-compressed strands having a cross-sectional area of 0.13 sq. mm; and
a covering part that is provided on the conductor part, wherein
the conductor part has an elongation of 7% or more and a tensile strength of 500 MPa or more, and
the covering part is made of 100 degree Celsius heat-resistant polyvinyl chloride and has an elongation of 100% or more at a temperature of −40 degree Celsius.

2. The highly bendable insulated electric wire according to claim 1, wherein
the number of times of reciprocating motion of the highly bendable insulated electric wire until a resistance value of the conductor part increases by 10% reaches 10,000 or more when a weight of 400 g is attached to one end of the highly bendable insulated electric wire and the one end is used as a fixed side and the other end side of the highly bendable insulated electric wire is bent repeatedly at a temperature of 23 degree Celsius and at a speed of 30 rpm in an angular range of from −90 degree to 90 degree by use of mandrels each of which has a radium of 12.5 mm; and the number of times of reciprocating motion of the highly bendable insulated electric wire until the resistance value of the conductor part increases by 10% reaches 3,000 or more when the weight of 400 g is attached to the one end and the one end is used as the fixed side while the other end side is bent repeatedly at a temperature of −30 degree Celsius and at the speed of 30 rpm in the angular range of from −90 degree to 90 degree by use of the mandrels each of which has the radium of 12.5 mm.

3. A wire harness comprising a highly bendable insulated electric wire according to claim 1.

4. A wire harness comprising a highly bendable insulated electric wire according to claim 2.

* * * * *